US007966674B2

(12) United States Patent
Olowofela

(10) Patent No.: US 7,966,674 B2
(45) Date of Patent: Jun. 28, 2011

(54) TOILET SEAT SAVER

(76) Inventor: Segun Olowofela, Springfield Gardens, NY (US)

( * ) Notice: Subject to any disclaimer, the term of this patent is extended or adjusted under 35 U.S.C. 154(b) by 813 days.

(21) Appl. No.: 11/906,852

(22) Filed: Oct. 4, 2007

(65) Prior Publication Data

US 2009/0089921 A1 Apr. 9, 2009

(51) Int. Cl.
*A47K 13/10* (2006.01)

(52) U.S. Cl. ..... 4/246.1; 4/253; 4/234; 4/236

(58) Field of Classification Search ..... 4/246.1, 4/242.1, 253, 234, 236; 220/328, 327, 246; 292/DIG. 2, 101, 196; 24/334, 507
See application file for complete search history.

(56) References Cited

U.S. PATENT DOCUMENTS 723,973 A * 3/1903 Alexander ..... 4/234
4,332,060 A 6/1982 Sato
4,833,737 A * 5/1989 Boucher et al. ..... 4/253
4,995,120 A * 2/1991 Tager ..... 4/246.1
5,669,081 A * 9/1997 Scherer et al. ..... 4/253
5,878,444 A * 3/1999 Convoy ..... 4/246.1
6,067,667 A 5/2000 Suzuki
6,163,894 A * 12/2000 Simonds ..... 4/246.1
6,983,492 B1 1/2006 Larson
7,039,961 B1 * 5/2006 Kirk ..... 4/246.1
2005/0223480 A1 * 10/2005 Miller et al. ..... 4/246.1
2008/0104744 A1 * 5/2008 Aviles Garcia ..... 4/253

* cited by examiner

*Primary Examiner* — Khoa D Huynh
(74) *Attorney, Agent, or Firm* — James Minerve

(57) ABSTRACT

An apparatus for opening and closing a toilet seat and lid. The apparatus comprises a clamp and a handle which attaches to a toilet lid. A user may open and close a toilet seat and/or lid by grasping the handle, in lieu of directly touching the toilet seat or lid. In preferred embodiments, the clamp contains a wireless controlled lever and motion detector which senses when a user moves away from the toilet, and automatically closes the toilet seat and or lid.

11 Claims, 9 Drawing Sheets

TOILET SEAT SAVER

CROSS REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

REFERENCE TO A SEQUENCE LISTING

Not Applicable

BACKGROUND OF THE INVENTION

1. Field of the Invention

The present invention generally relates to devices used to open and close toilet seats and lids without a user having to directly touch the toilet.

2. Description of Related Art

Inventions related to operating commode seats and lids date back to the 1930's. The problem inventors in this field sought to solve heretofore is very basic: spare mankind from the unsanitary ritual of having to directly touch a soiled commode. In attempting to solve this problem inventors seemed to spare neither expense nor complexity. The most complicated and expensive remedies are the so called automatic commode seats and lids. This line of devices included specially made commodes with hydraulic, pneumatic, or even hard-wire electrical controls. These solutions proved to be quite impractical. The horsepower of the motors or driving components required to pivotally open and lower a commode seat and lid emitted a disturbing level of noise for residential use. Installation of such automatic appurtenances usually required construction or replacement of conventional commodes. Homeowners would rather deal with an objectionable toilet rather than incur the cost of construction or toilet replacement. The so called automatic toilets proved too costly for its worth.

Despite the vast number and types of inventions in this field, none have reached any notable level of consumer satisfaction. Although literally thousands of these types of inventions are available to the public, it is still rare to find one in bathrooms, especially residential bathrooms. That is not to say that consumers do not crave for a solution to the age old problem. In deed, the enormous attention inventors have devoted to this problem is testament that a need for a solution exists. And the fact that none of the enumerable patented inventions devoted to the problem have achieved commercial success leads to the inescapable conclusion: thus far inventors have fallen short of consumer demand for a practical solution. Based on prior attempts and failures to meet consumer demand, it seems clear that a commercially viable solution would have to be simple and inexpensive.

Therefore, objects of the present invention are to devise a very simple and inexpensive means to insulate people from having to touch commodes (at least with their hands): simple to make, simple to use, and simple to install. Simple in these regards do not always translate into inexpensive to purchase at retail level. For example, computers are simpler than ever to use. Although cheaper than ever to buy, a descent one still costs upwards of one thousand dollars, which is not exactly an inexpensive consumer purchase from the neighborhood mega store. An object of this invention is to devise an apparatus, the cost of which is not out of range with typical bathroom accessories. It seems plausible that a consumer would invest a typical expense of a typical bathroom accessory for a novel easy to install device purported to address a typical bathroom problem. In light of the failures of the prior art to meet the public need in this regard, the overarching object of the present invention is to develop a solution that will achieve commercial success.

BRIEF SUMMARY OF THE INVENTION

The present invention provides an apparatus for opening and closing a toilet seat and lid. The apparatus comprises a clamp and a handle pivotally connected and hinged about the longitudinal axis of a cylindrical shaped shaft or spine between the handle and the clamp. The spine has longitudinal and transverse axes. The spine comprises interconnected knuckles. A knuckle is a cylindrical shaft to which one of the ends of a planar leaf is attached. To form the spine, the interconnected knuckles are arranged end-to-end along their longitudinal axes, the same way a conventional door hinge has interconnected cylindrical shafts (in which a pin is inserted to hold the knuckles together).

The clamp jaws and handle connection is virtually fixed. However, squeezing the handle slightly opens the free ends of the clamp jaws. The pivotal angle between the clamp jaws inside surfaces is essentially 90°. The lower jaw has a detent on the inside surface free end. The clamp attaches to a toilet seat and lid, by attaching the clamp upper jaw inside surface to a toilet lid. The lower jaw inside surface contacts the sides of the toilet seat and lid when the lid and seat are down. In this position, the detent is sized and arranged to restrain the toilet seat from separating from the lid. A user lifting the handle without squeezing the handle lifts the toilet seat and lid. Whereas, a user lifting the handle while squeezing the handle causes the detent to release the toilet seat, resulting in the clamp lifting only the toilet lid. In using the apparatus in this manner, the user never directly touches the toilet seat or lid.

Other objects and advantages of the present invention will be readily apparent upon a reading of the following brief descriptions of the drawing figures, detailed descriptions of preferred embodiments of the invention, the appended claims and drawings.

BRIEF DESCRIPTION OF THE SEVERAL VIEWS OF THE DRAWINGS

The above mentioned and other objects and features of this invention and the manner of attaining them will become apparent, and the invention itself will be best understood by reference to the appended drawings. In the course of the following detailed description, reference will be made to the appended drawings in which.

DETAILED DESCRIPTION OF THE INVENTION

Figure 1B:
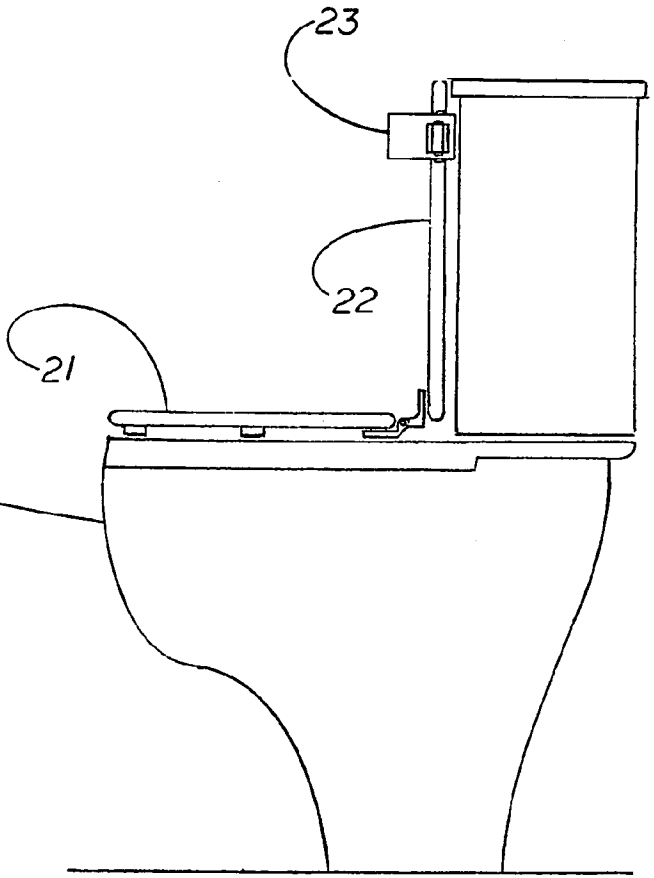
FIG. 1B Elevation of clamp attached to Toilet Lid.
Figure 7:
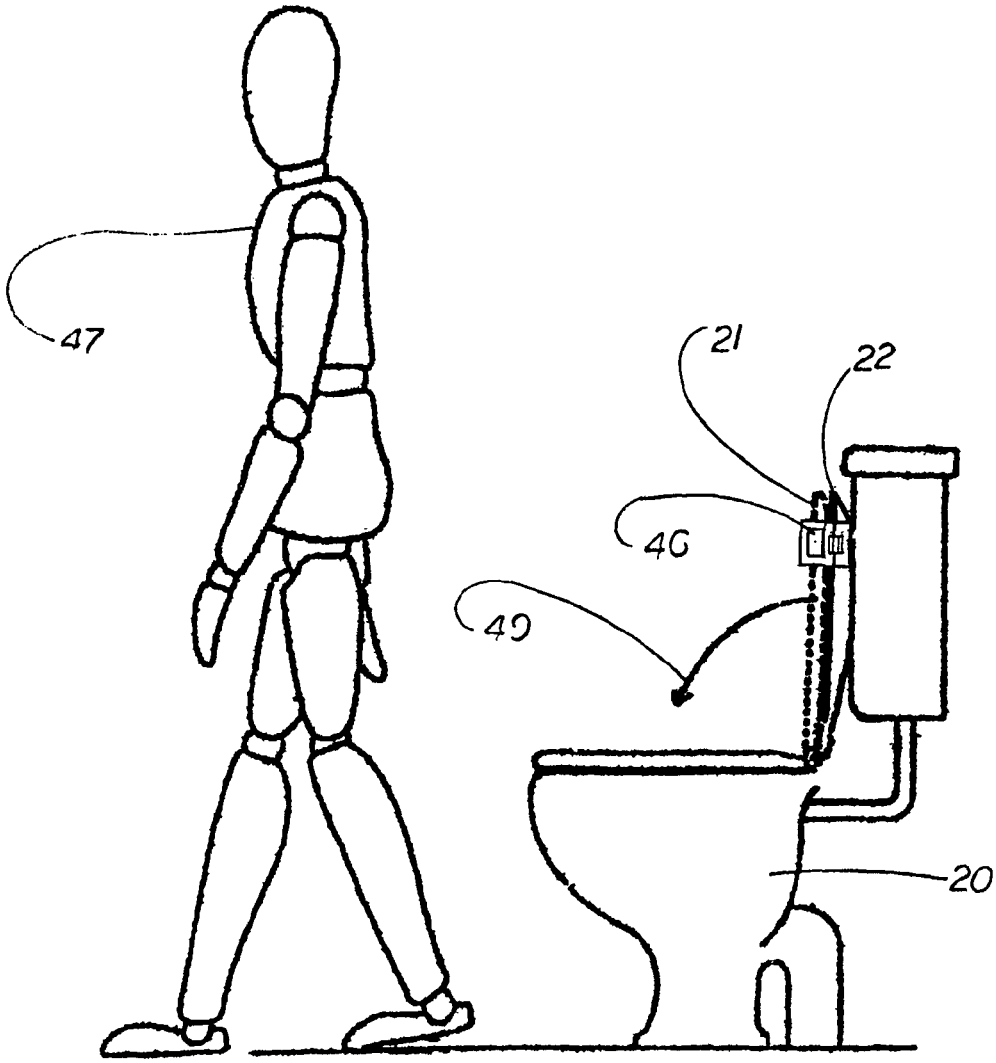
FIG. 7 Elevation of Clamp with Motion Detector Attached to Toilet Seat and Lid in Motion.

In the following description, like reference characters designate like or corresponding parts throughout the several views. Referring now to the drawings in detail, reference is made to FIGS. 1A, 1B, and 2. The present invention is an apparatus for opening and closing a toilet seat 21 and toilet lid 22. A preferred embodiment of the apparatus comprises a clamp 23, a spring 35, a motor 44, first pin 40, second pin 39, and a wireless controller 46, as in FIG. 4. These components are interconnected enabling a user 47 (as in FIG. 7) to manually lift the toilet seat 21 and/or toilet lid 22 with the apparatus, and when the toilet seat 21 and/or toilet lid 22 is/are up with the apparatus connected to the toilet lid 22, the apparatus is capable of closing the toilet seat 21 and/or toilet lid 22 automatically.

The clamp 23, comprises a first rectangular plate 25, a second rectangular plate 24, and third rectangular plate 27; a first knuckle 38, a second knuckle 28, and third knuckle 37, and a handle 26.

Each plate 24, 25, 27 has inside and outside plate surfaces; and first 50, second 51, third 52, and forth 53 plate edges. The first plate 25 inside surface has ridges 29 across the first plate 25 inside surface; a detent 45 along the first plate 25 second edge 51 facing the first plate 25 inside surface. The second plate 24 has a slot 33 in the second plate 24 third edge 52. The third plate 27 has a slot 36 in the third plate 27 third edge 52.

Figure 2:
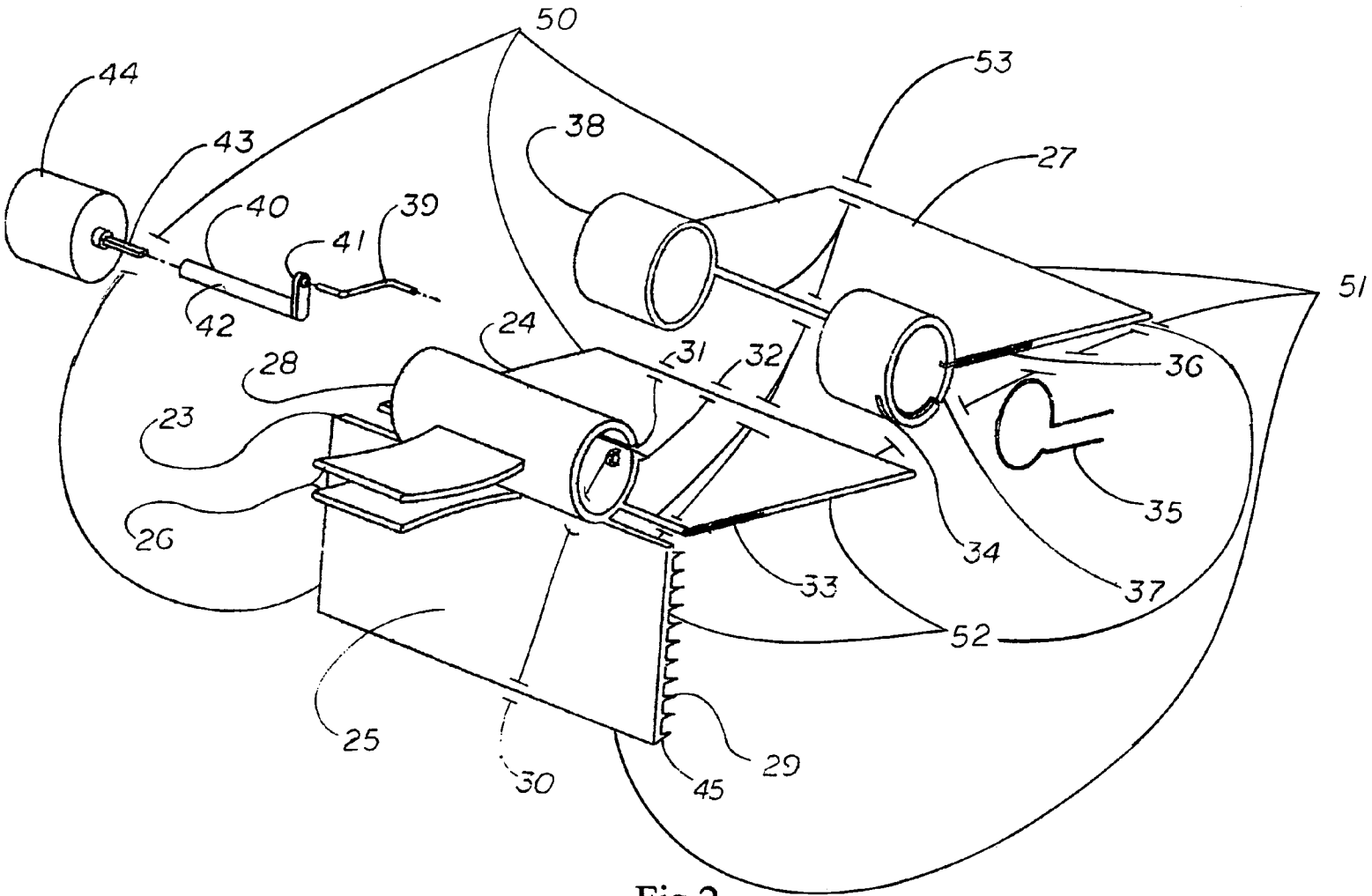
FIG. 2 Exploded View of Clamp with Motor and Lever.
Figure 3:
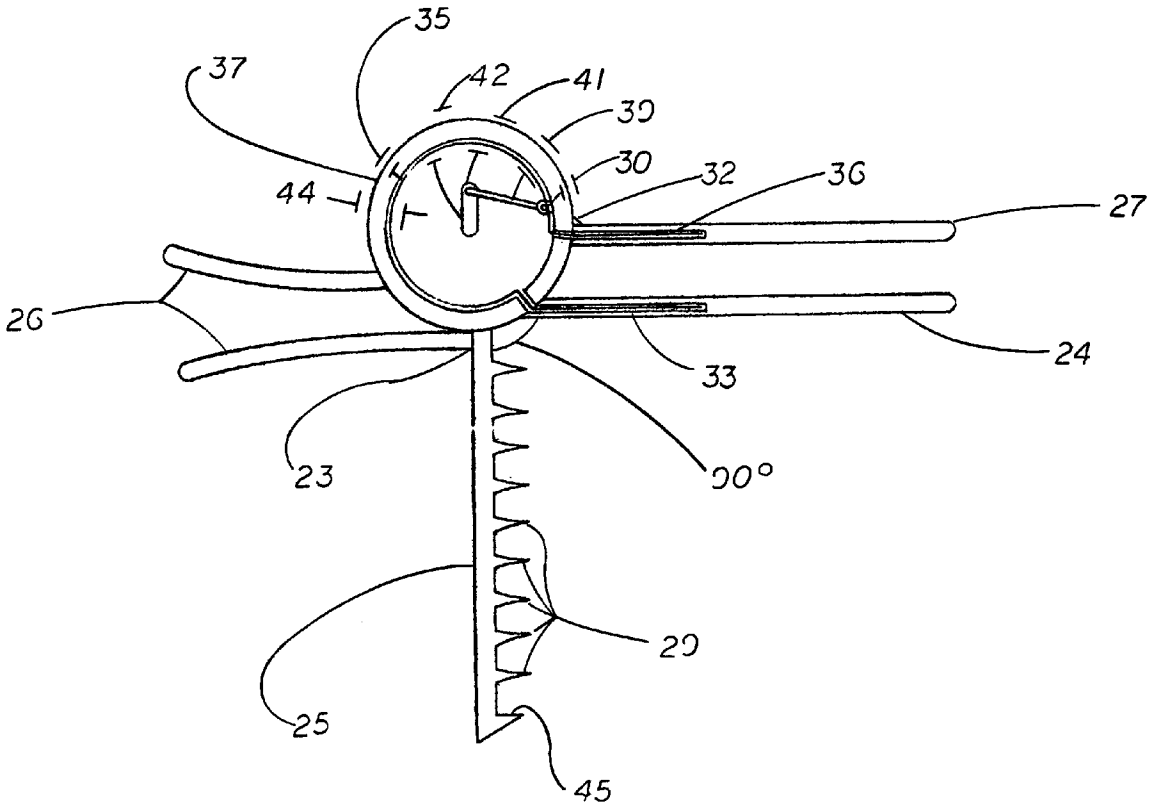
FIG. 3 Side View of Clamp with Motor and Lever.

Each knuckle 27, 37, 38 comprises hollow and cylindrical configurations (as shown in FIG. 2), interior and exterior knuckle surfaces, longitudinal and transverse knuckle axes, and first and second opposing circular knuckle edges. The second knuckle 28 has longitudinal upper and lower edges forming a longitudinal gap 31 (as shown in FIG. 2) in the second knuckle 28. The second knuckle 28 lower edge having a detent 32 (as in FIG. 2) on the second knuckle 28 exterior surface. The second knuckle 28 lower edge has a loop 30 protruding on the second knuckle 28 inside surface opposite the detent 32 on the second knuckle 28 outside surface.

The first plate 25 fourth edge 53 and second plate 24 fourth edge 53 are fixedly connected to the second knuckle 28 exterior surface along the second knuckle 28 longitudinal axis below the second knuckle 28 detent 32. The inside surfaces of both the first and second plates 24, 25 are facing and are essentially perpendicular to each other. The third plate 27 fourth edge 53 is fixedly connected to the first and third knuckles' 37, 38 exterior surfaces along their longitudinal axes. The first and third knuckles 37, 38 are spaced apart along the third plate 27 fourth edge 53.

The first and third knuckles 37, 38 are detachably and rotatably attached to the second knuckle 28 aligning their longitudinal axes forming a hinge and a hinge axis about which the third plate 27 rotates, arranged so that the third plate 27 is lodged under the second knuckle detent 32 preventing counter clockwise rotation of the third plate 27; and arranged so that the third plate 27 is essentially parallel to the second plate 24.

The spring 35 comprises a substantially circular middle section, first and second substantially straight edges. The spring 35 is biased against the joining of the first and second spring edges. The spring circular middle section is inserted in the slot 34 on the third knuckle second edge (as in FIG. 2). The first spring edge is inserted inside the slot 36 on the third plate fourth edge (as in FIG. 2). The second spring edge is inserted in the slot 33 in the second plate 24 third edge 52. The spring 35 so inserted and being biased as such, the third plate 27 would rotate about the hinge axis but for the second knuckle detent 32 restraining the third plate 27 (as in FIG. 4).

Figure 4:
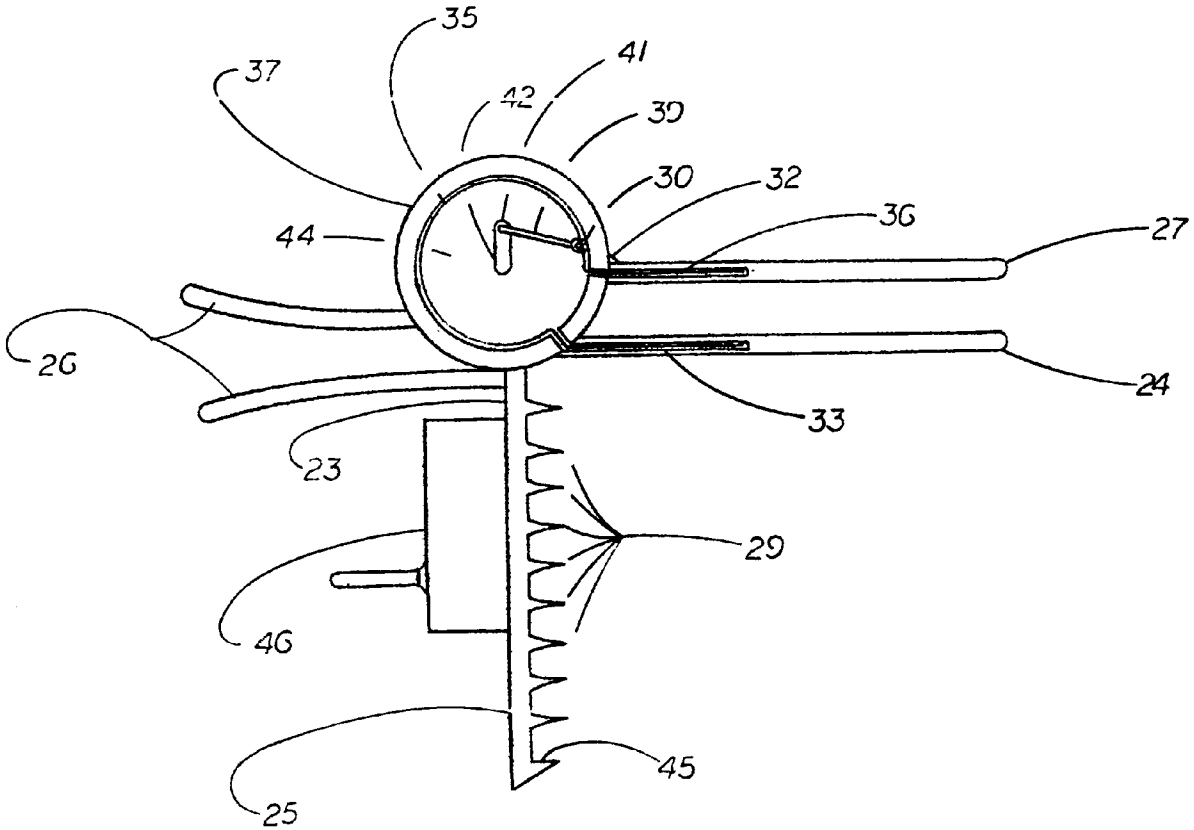
FIG. 4 Side View of Clamp with Motor, Lever, and Wireless Controller.
Figure 5:
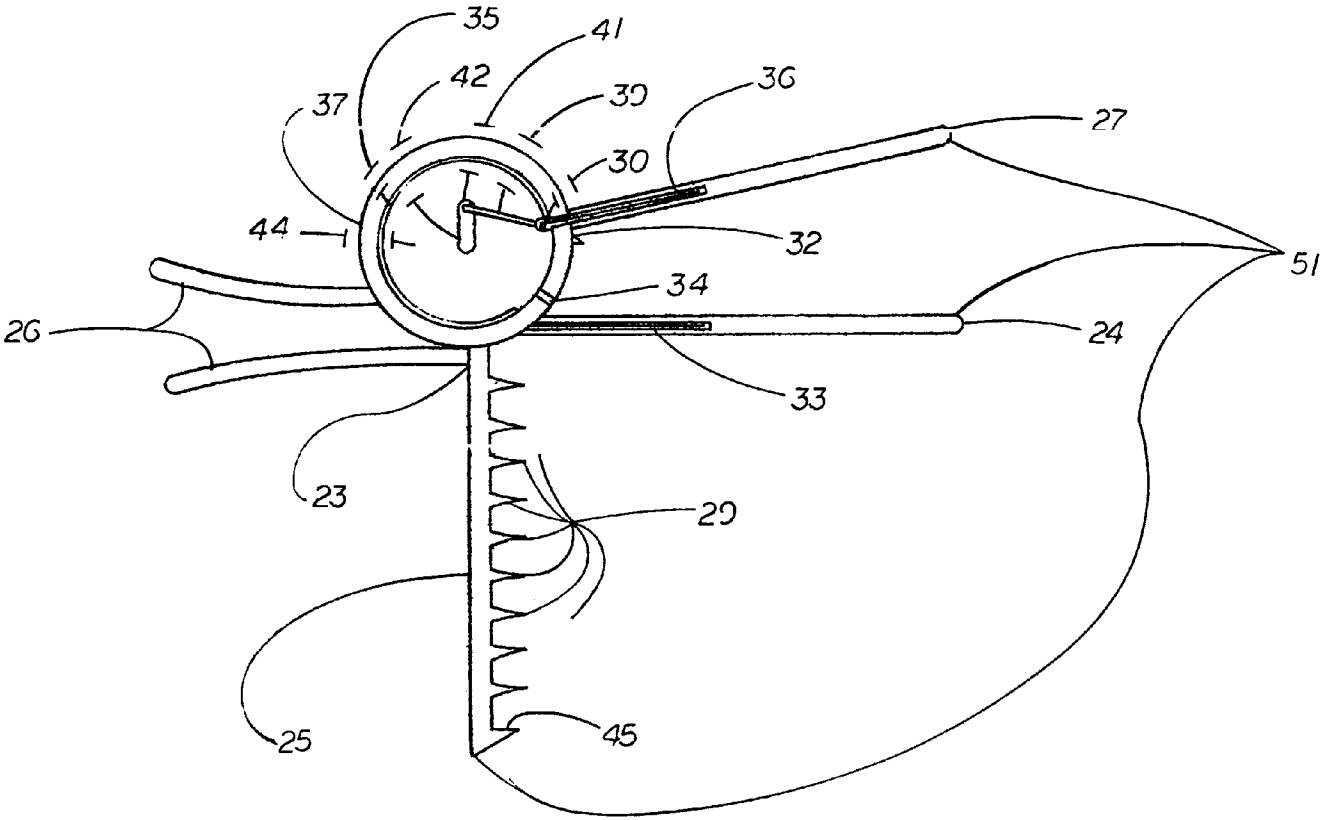
FIG. 5; Side View of Clamp with Motor, Lever released by Detent, and Wireless Controller FIG. 6 Elevation of Clamp with Motion Detector Attached to Toilet Seat and Lid.
Figure 6:
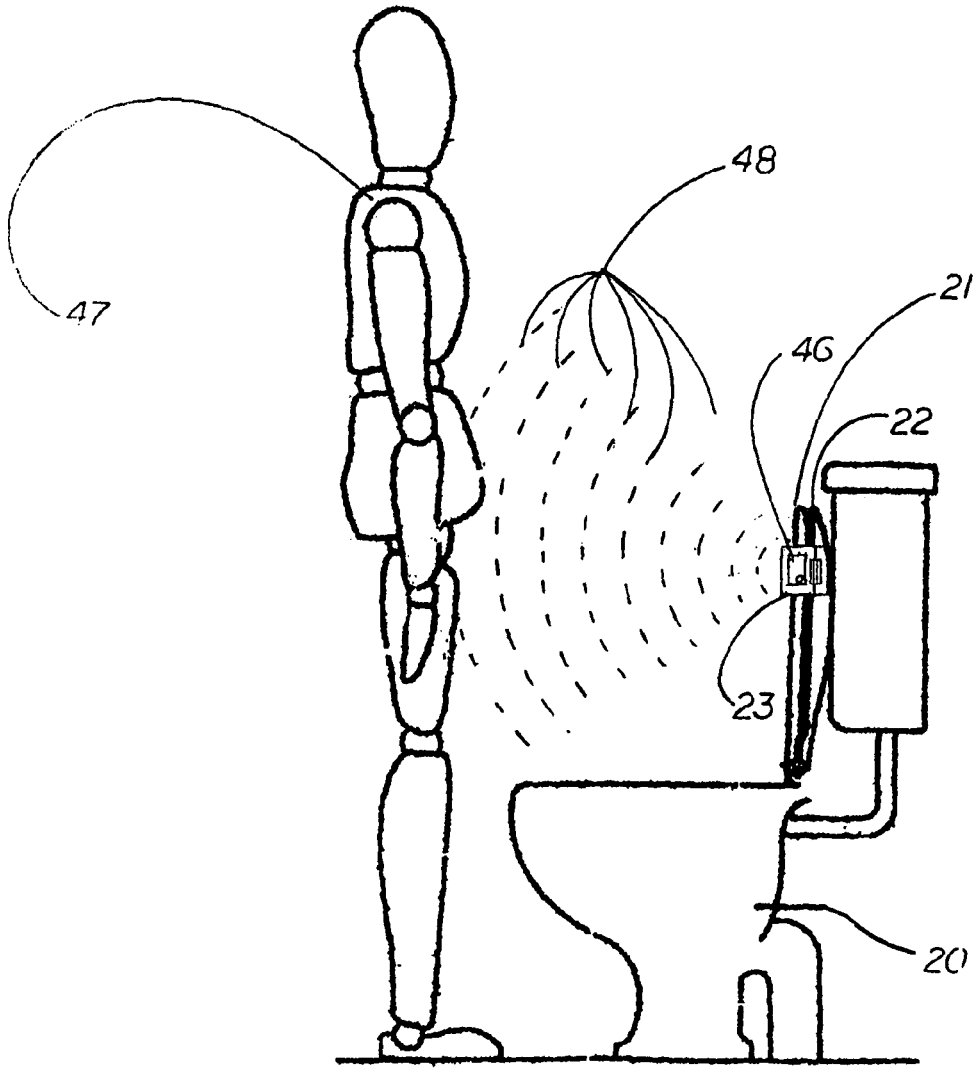

The motor 44 comprises a substantially piston configuration sized to fit inside the first knuckle (as in FIGS. 2, 4, and 5). The motor 44 has a motor protruding drive shaft 43. The first pin 40 comprises a cylindrical section 42 and a boot section 41 (as in FIG. 2). The boot section 41 has an aperture (as in FIG. 2). The second pin 39 has first and second ends (as in FIG. 2).

The motor 44 is inserted inside the first knuckle first edge with the motor drive shaft 43 pointing inside the second knuckle 28 (as in FIGS. 2, 4, and 5). The first pin cylindrical section 42 is inserted over the motor drive shaft 43. The second pin 39 first end is inserted in the first pin 40 boot aperture (as in FIG. 2). The second pin 39 second end is inserted in the loop 30 on the second knuckle 28 inside surface (as in FIG. 2).

Upon activating the motor 44, the motor shaft 43 rotates counter clockwise, turning the first pin 40 cylindrical section 42 counter clockwise, turning the boot 41 aperture counter clockwise, pulling the second pin 39 first end, which pulls the second pin 39 second end, which pulls the loop 30 on the second knuckle 28 lower edge toward the inside of the second knuckle 28, which pulls the second knuckle detent 32 toward the second knuckle 39 inside surface releasing the third plate 27 (as in FIG. 5). As such, the biased spring 35 causes the third plate to rotate about the hinge axis (as in FIG. 5), wherein the third plate 27 second edge 51 moves away from the second plate 24 second edge 51 (as in FIG. 5).

The handle 26 is attached to the second knuckle 28 and the first plate 25, wherein a person squeezing the handle 26 causes the first plate 25 second edge 51 to pivot clockwise about the hinge axis, causing the first plate 25 second edge 51 and first plate detent 45 to move away from second plate 24 second edge 51 (as in FIG. 4).

Figure 1A:
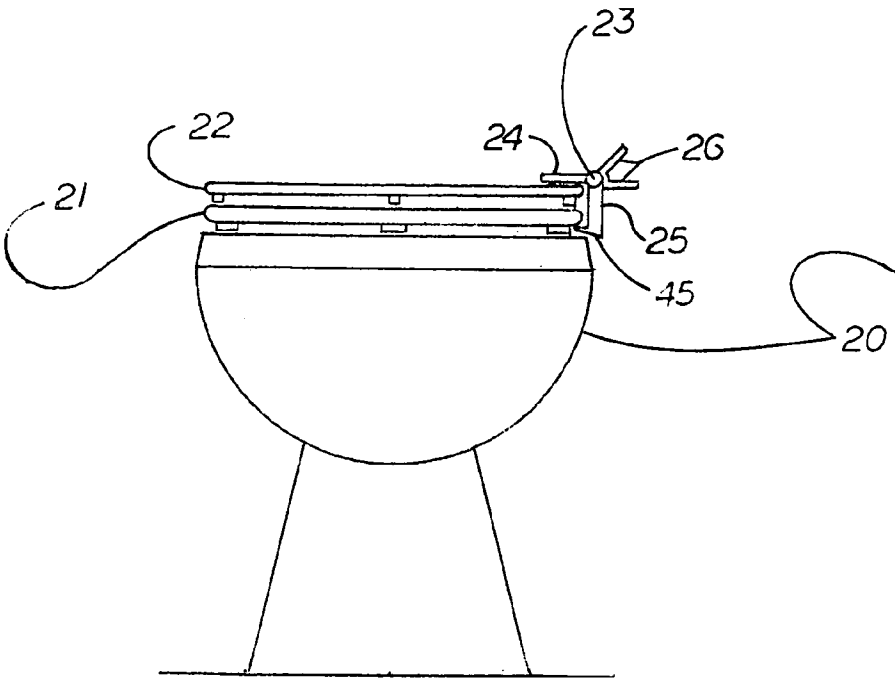
FIG. 1A Elevation of clamp attached to Toilet Seat and Lid.

The second plate 24 inside surface is attached to a toilet lid 22 (as in FIG. 1A). When the toilet seat 21 and toilet lid 22 are down with the second plate 24 attached to the toilet lid 22, the detent 45 on the first plate second edge 51 restrains the toilet seat bottom (as in FIG. 1A); such that when a person lifts the handle 26 without squeezing the handle 26, both the toilet seat 21 and toilet lid 22 rises. Whereas when a person lifts the handle 26 while squeezing the handle 26, only the toilet lid 22 rises (as in FIG. 1B).

Referring now to FIG. 5, another preferred embodiment comprises a clamp 23 and a handle 26 pivotally connected and hinged about the longitudinal axis of a cylindrical shaped spine 37 (or shaft) between the handle 26 and the clamp 23. The spine 37 has longitudinal and transverse axes. The spine 37 comprises interconnected knuckles. The clamp 23 jaws and handle 26 connection is virtually fixed. However, squeezing the handle 26 slightly opens the free ends 51 of the clamp 23 jaws. The pivotal angle between the clamp jaw inside surfaces is essentially 90°. The lower jaw 25 has a detent 45 on the inside surface free end. The clamp 23 attaches to a toilet seat and lid, by attaching the clamp 23 upper jaw 24 inside surface to a toilet lid. The lower jaw 25 inside surface contacts the sides of the toilet seat and lid when the lid and seat are down. In this position, the detent 45 is sized and arranged to restrain the toilet seat from separating from the lid.

The lower jaw 25 contains flexible ridges 29 across the inside surface; these ridges 29 come in contact with the side of the toilet seat when the lid is lowered onto the toilet seat; but these ridges 29 do not prevent the detent 45 from restraining the toilet seat; wherein the toilet seat down and the lid up with the upper jaw 24 attached to the lid, and a user pulling the handle 26 such that the toilet lid essentially closes by gravity, the ridges 29 come in contact with the toilet seat side, brushing into the toilet seat side, each ridge 29 impacting against the toilet seat side, each ridge 29 slightly absorbing some of the impact of the toilet lid slamming on top of the toilet seat, whereby the ridges 29 dampen the sound of the free falling toilet lid slamming onto the toilet seat.

Still referring to FIG. 5, the flexible ridges 29 could comprise various forms. For example the flexible ridges 29 could comprise slender flexible spikes, having a spike base end, a spike free end, a spike longitudinal axis, and a spike transverse diameter approximately equal to the diameter of a toothpick; the spike base end being attached to the lower jaw 25 inside surface; along the spike longitudinal axis, the spike diameters are fatter at the spike base end, and gradually decreases in diameter toward the spike free end; the length of the spikes are sized such that the spike free ends brush against the side of the toilet seat when the clamp 23 upper jaw 24 is attached to the toilet lid.

However, still referring to FIG. 5, the flexible ridges 29 could also comprise protruding strips of flexible material; each strip having a base end and protruding free end; each base end having a base width and length; each strip base end width is thicker than each strip free end; each strip base length is aligned essentially parallel to the spine 37 longitudinal axis; the strips are sized such that the strip free end brushes against the side of the toilet seat when the upper jaw 24 is attached to the toilet lid.

The upper jaw 24, as in FIG. 1A, may be attached to a toilet lid using any conventional method. However, the upper jaw 24 may also be built into a toilet lid. A toilet seat and lid with a built in clamp 23 could be sold as a unit. Homeowners could simply purchase this unit at a retail home furnishings store. Installation would be a breeze. Simply unscrew the conventional toilet seat-lid unit, and screw-in the toilet seat and lid with the built in clamp (not shown).

Figure 1C:
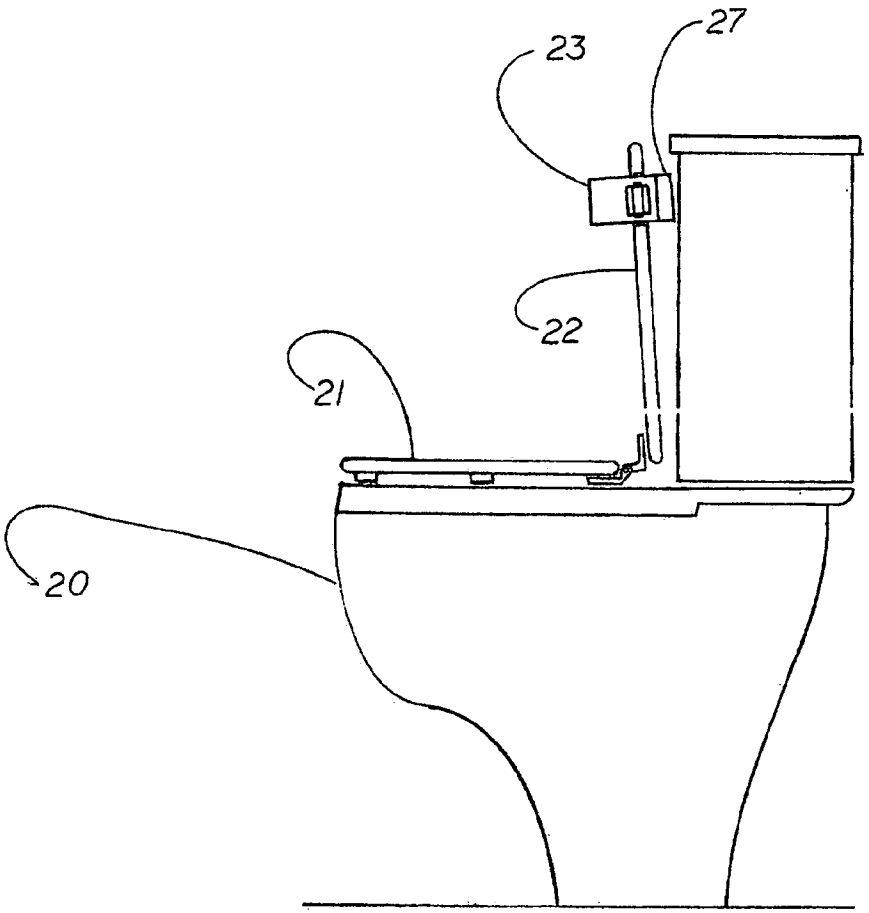
FIG. 1C Elevation of clamp with Lever attached to Toilet Seat Lid.
Figure 8:
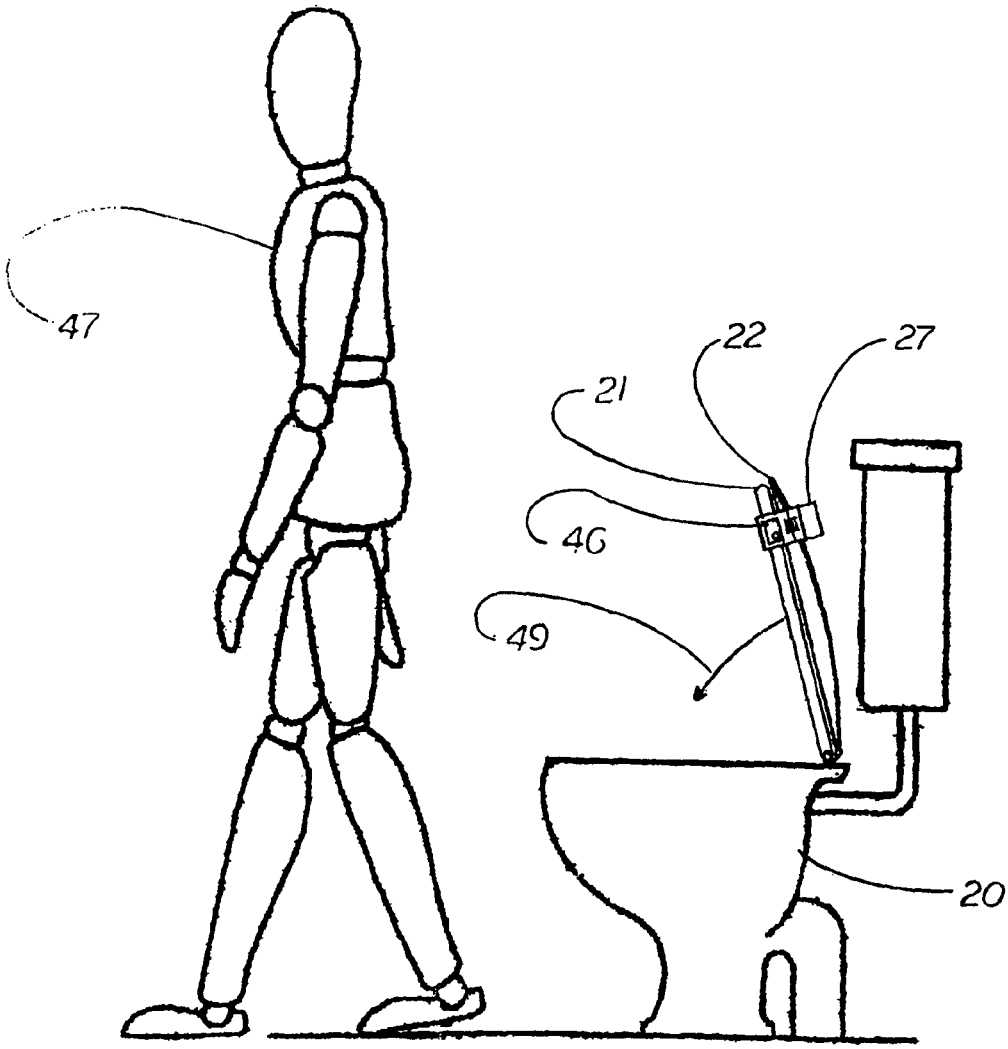
FIG. 8 Elevation of Clamp with Motion Detector Attached to Toilet Seat and Lid, in Motion and Lever Released from Detent.

Again referring to FIG. 5, also referring to FIGS. 1C and 8, the clamp 23 could contain a mechanism to automatically close the toilet seat and lid. To this end a preferred embodiment contains a lever 27. The spine 37 contains a detent 32. The lever 27 has a pivotal end and a free end, an inside surface and outside surface. The lever 27 is pivotally connected to the spine 37 about the spine 37 longitudinal axis. The lever 27 is situated between the handle 26 and the upper jaw 24 outside surface. When a user lifts the toilet lid to the point where the toilet lid's weight tilts the toilet lid against the toilet tank, as in FIG. 1B, the weight of the toilet lid forces the lever 27 free end into the toilet tank causing the lever 27 to rotate toward the upper jaw 24 outside surface until the spine detent 32 restrains the lever 27. When the spine detent 32 releases the lever 27, the lever 27 free end swings about the lever 27 pivotal end, and the lever 27 free end slams into the toilet tank with such force that the impact forces the toilet lid to move away from the tank until gravity causes the weight of the toilet lid to close, as in FIG. 8.

In stead of the motor 44 controlling the spine detent 32, as described above; the spine detent 32 could contain a spring actuator (not shown). In a preferred embodiment, the spring actuator contains a timer (not shown). After a user lifts the toilet lid causing the spine detent 32 to restrain the lever 24 (as stated), after a preset period of time, the timer actuates the spring actuator causing the spine detent 32 to release the lever 24.

However, the best mode utilizes a miniature battery operated motor 44 (which is connected to the spine detent 32 as described above) and Wireless technology to restrain and release spine detent 32. Referring now to FIGS. 4, 6, 7, and 8, a preferred embodiment contains a wireless controller 46 mounted on the lower jaw 25. The wireless controller 46 has a sensor 48. The sensor 48 detects motion. However, under another preferred embodiment, the sensor 48 detects motion of a person near the toilet lid, as in FIG. 6, and when such person moves away from the toilet lid, as in FIG. 7. A certain period of time after the person moves away from the toilet lid, the wireless controller 46 causes the spine detent 32 to release the lever 27, as in FIG. 8. The best mode contains a battery operated wireless controller 46, hard wired to a battery operated motor 44. The Motor 44 is connected to the spine detent 39, as described above. Under the best mode, upon a certain period of time after a person moved away from the toilet lid, the wireless controller 46 activates the motor, which causes the spine detent 32 to release the lever 27, as described above and depicted in FIG. 8.

Under the best mode the wireless controller 46 is also activated by a remote control (not shown). The remote control has a button. The wireless sensor 48 detects when a user presses the button, and the sensor activates the wireless controller 46, which activates the motor 44 causing the spine detent 32 to release the lever 27, as described above. Therefore, if the toilet seat and/or lid was left up and if a person wanted to use the toilet and not wait for the preset period of time to elapse, the person could simply press the remote control button to activate, which would ultimately close the toilet seat lid automatically.

While the invention has been disclosed in preferred forms, it will be apparent to those skilled in the art that many modifications, additions, and deletions may be made therein without departing from the spirit and scope of the invention as set forth in the following claims.

What is claimed is:

1. A toilet assembly comprises a toilet tank, a toilet seat adapted to be pivotally positioned on top of an opening of a toilet bowl via a hinge assembly, a toilet lid pivotally mounted on top of the toilet seat via the hinge assembly and an apparatus for opening and closing the toilet seat and the toilet lid, the apparatus further comprising, a clamp having lower and upper jaws, a spine having a longitudinal axis, and a handle; each jaw has a pivotal end and an opposing free end, the jaws pivotal ends are pivoted about the longitudinal axis of the spine, the jaws have inside and outside surfaces, the jaws inside surfaces face each other; the lower jaw has a detent formed on the inside surface free end; the handle is pivoted about the spine longitudinal axis opposite the jaws pivotal ends; a pivotal angle between the lower and upper jaws inside surfaces is essentially 90°; the handle is connected to the jaws such that squeezing the handle causes the pivotal angle between the jaws to increase slightly, whereby the detent on the lower jaw free end moves away from the upper jaw free end; the clamp attaches to the toilet seat and the toilet lid, by attaching the upper jaw inside surface to the toilet lid, wherein the lower jaw inside surface contacts the sides of the toilet seat and the toilet lid when both the toilet seat and the toilet lid are down on top of the toilet bowl in which the opening is covered, wherein the detent restrains the toilet seat from separating from the toilet lid; wherein a user lifting the handle without squeezing the handle lifts both the toilet seat and the toilet lid, and wherein the user lifting the handle while squeezing the handle causes the detent to release the toilet seat, resulting in the clamp lifting only the toilet lid; in using the apparatus in this manner, the user never has to directly touch the toilet seat or the toilet lid;

wherein the lower jaw contains flexible ridges across the inside surface; these ridges come in contact with the side of the toilet seat when the toilet lid is lowered onto the toilet seat; but these ridges do not prevent the detent from restraining the toilet seat; wherein the toilet seat down and the lid up with the upper jaw attached to the lid, and a user pulling the handle such that the toilet lid essentially closes by gravity, the ridges come in contact with the toilet seat side, brushing into the toilet seat side, each ridge impacting against the toilet seat side, each ridge slightly absorbing some of the impact of the toilet lid slamming on top of the toilet seat, whereby the ridges dampen the sound of the free falling toilet lid slamming onto the toilet seat;

wherein the upper jaw is built into a toilet lid;

wherein the clamp further contains a lever, and the spine contains a detent; the lever having a pivotal end and a free end, an inside surface and outside surface; the lever is pivotally connected to the spine about the spine longitudinal axis, the lever being disposed between the handle and the upper jaw outside surface; when the user lifts the toilet lid to a point where the toilet lid's weight tilts the toilet lid against the toilet tank, the weight of the toilet lid forces the lever free end into the toilet tank causing the lever to rotate toward the upper jaw outside surface until the spine detent restrains the lever; when the spine detent releases the lever, the lever free end swings about the lever pivotal end, wherein the lever free end slams into the toilet tank with such force that the impact forces the toilet lid to move away from the toilet tank until gravity causes the weight of the toilet lid to close;

wherein the clamp further contains a wireless controller having a wireless sensor; the sensor detects motion; the wireless controller is attached to the outside surface of the lower jaw and controls the movement of the spine detent; the sensor detects when the user is near the toilet lid and when the user moves away from the toilet lid; wherein a certain period of time after the user moves away from the toilet lid, the wireless controller causes the spine detent to release the lever; wherein the clamp further contains a motor; the motor is connected to the spine detent and the wireless controller; after the certain period of time has elapsed, the wireless controller activates the motor causing the spine detent to release the lever.

2. The clamp in claim 1, wherein the flexible ridges are slender flexible spikes, having a spike base end, a spike free end, a spike longitudinal axis, and a spike transverse diameter approximately equal to the diameter of a toothpick; the spike base end being attached to the lower jaw inside surface; along the spike longitudinal axis, the spike diameters are fatter at the spike base end, and gradually decreases in diameter toward the spike free end; the length of the spikes are sized such that the spike free ends brush against the side of the toilet seat when the upper jaw is attached to the toilet lid.

3. The clamp in claim 1, wherein the flexible ridges are protruding strips of flexible material; each strip having a base end and protruding free end; each base end having a base width and length; each strip base end width is thicker than each strip free end; each strip base length is aligned essentially parallel to the spine longitudinal axis; the strips are sized such that the strip free end brushes against the side of the toilet seat when the upper jaw is attached to the toilet lid.

4. The clamp in claim 1, wherein the spine detent contains a spring actuator.

5. The clamp in claim 4, wherein the spring actuator contains a timer; wherein upon a user lifting the toilet lid causing the spine detent to restrain the lever, after a preset period of time, the timer actuates the spring actuator causing the spine detent to release the lever.

6. The clamp in claim 1, wherein the wireless controller is battery powered.

7. The clamp in claim 1, wherein the motor is battery powered.

8. The clamp in claim 7, wherein the motor is sized to fit inside the spine.

9. The clamp in claim 8, wherein the wireless controller is activated by a remote control.

10. The clamp in claim 1, wherein the wireless controller further includes a remote control having a button; the wireless controller is attached to the outside surface of the lower jaw and controls the movement of the spine detent; the wireless sensor detects when a user presses the button, and the sensor activates the wireless controller causing the spine detent to release the lever.

11. An apparatus for opening and closing a toilet seat and lid, comprising, a clamp, a spring, a motor, first and second pins, and a wireless controller; all of which are interconnected enabling a user to manually lift the toilet seat and/or lid with the apparatus, and when the toilet seat and/or lid is/are up with the apparatus connected to the lid, the apparatus is capable of closing the toilet seat and/or lid automatically;

the clamp, comprising first, second and third rectangular plates; first, second, and third knuckles, and a handle;

each plate having, inside and outside plate surfaces; each plate having, first, second, third, and forth plate edges; the first plate inside surface having ridges across the first plate inside surface; the first plate having a detent along the first plate third edge facing the first plate inside surface; the second plate having a slot in the second plate fourth edge, the third plate having a slot in the third plate fourth edge;

each knuckle comprising, hollow and cylindrical configurations, interior and exterior knuckle surfaces, longitudinal and transverse knuckle axes, first and second opposing circular knuckle edges; the second knuckle having, longitudinal upper and lower edges, the second knuckle upper and lower edges forming a longitudinal gap in the second knuckle; the second knuckle lower edge having a detent on the second knuckle exterior surface, the second knuckle lower edge having a loop protruding on the second knuckle inside surface opposite the detent on the second knuckle outside surface;

the first plate first edge and second plate first edge are fixedly connected to the second knuckle exterior surface along the second knuckle longitudinal axis below the second knuckle detent; the inside surfaces of both the first and second plates are facing and are essentially perpendicular to each other; the third plate first edge is fixedly connected to the first and third knuckles' exterior surfaces along their longitudinal axes; the first and third knuckles are spaced apart along the third plate first edge;

the first and third knuckles are detachably and rotatably attached to the second knuckle aligning their longitudinal axes forming a hinge and a hinge axis about which the third plate rotates, all knuckles arranged so that the third plate is lodged under the second knuckle detent preventing counter clockwise rotation of the third plate; and all knuckles arranged so that the third plate is essentially parallel to the second plate;

the spring comprises, a substantially circular middle section, first and second substantially straight edges; the spring is biased against the joining of the first and second spring edges; the spring middle section is inserted in the slot on the third knuckle second edge; the first spring edge is inserted inside the slot on the third plate fourth edge; the second spring edge is inserted in the slot in the second plate fourth edge; the spring so inserted and being biased as such, the third plate would rotate about the hinge axis but for the second knuckle detent restraining the third plate;

the motor comprising, substantially a piston configuration sized to fit inside the first knuckle, the motor having a motor protruding drive shaft; the first pin comprising a cylindrical section and a boot section, the boot section having an aperture; the second pin having first and second ends;

the motor is inserted inside the first knuckle first edge with the motor drive shaft pointing inside the second knuckle; the first pin cylindrical section is inserted over the motor drive shaft; the second pin first end is inserted in the first boot aperture; the second pin second end is inserted in the loop on the third knuckle inside surface;

upon activating the motor the motor shaft rotates counter clockwise, turning the first pin cylindrical section counter clockwise, turning the boot aperture counter clockwise, pulling the second pin first end, which pulls the second pin second end, which pulls the loop on the second knuckle lower edge toward the inside of the second knuckle, which pulls the second knuckle detent toward the second knuckle inside surface releasing the third plate; as such, the biased spring causes the third plate to rotate about the hinge axis, wherein the third plate second edge moves away from the second plate second edge;

the handle is attached to the second knuckle and the first plate; wherein a person squeezing the handle causes the first plate second edge to pivot clockwise about the hinge axis, causing the first plate second edge and first plate detent to move away from second plate second edge;

the second plate inside surface is attached to a toilet lid; when the toilet seat and lid are down with the second plate attached to the toilet lid, the detent on the first plate second edge restrains the toilet seat bottom; such that when a person lifts the handle without squeezing the handle, both the toilet seat and lid rises; when a person lifts the handle while squeezing the handle, only the lid rises.

* * * * *